United States Patent [19]

Legueu

[11] 4,210,355

[45] Jul. 1, 1980

[54] AIR-TRANSPORTABLE HIGHLY AUTONOMOUS CROSS-COUNTRY MEDICAL VEHICLE

[75] Inventor: Paul E. R. Legueu, Pornichet, France

[73] Assignee: A.C.M.A.T. Ateliers de Constructions Mecaniques de l'Atlantique, Saint Nazaire, France

[21] Appl. No.: 945,333

[22] Filed: Sep. 25, 1978

[30] Foreign Application Priority Data

Jan. 11, 1978 [FR] France ..... 78 00639

[51] Int. Cl.[2] ..... A61G 3/00

[52] U.S. Cl. ..... 296/19; 5/9 R

[58] Field of Search ..... 296/19, 20, 156, 168; 5/8, 9 R, 9 B

[56] References Cited

U.S. PATENT DOCUMENTS

| | | | |
|---|---|---|---|
| 1,284,936 | 11/1918 | Shine | 296/19 |
| 2,375,896 | 5/1945 | Cox | 296/19 |
| 2,387,186 | 10/1945 | Schofield | 296/19 |
| 2,627,611 | 2/1953 | Nichols | 5/9 R |
| 2,840,101 | 6/1958 | Saylor | 296/156 |
| 4,115,884 | 9/1978 | Keagh | 296/19 |

FOREIGN PATENT DOCUMENTS

| | | | |
|---|---|---|---|
| 526570 | 3/1954 | Belgium | 296/19 |

*Primary Examiner*—Robert R. Song

[57] ABSTRACT

The medical vehicle is capable of travelling over long distances (1 600 km) in particular in desert regions and comprises a chassis carrying a drive unit and a closed body containing the equipment for medical intervention and caring for victims of accidents or injured persons. The rear end wall of the body is provided with two outwardly openable door members. The body contains at least two superimposed stretchers which are removably supported by a stand which is movable between two angularly different positions, namely a transport position in which the stand is parallel to the longitudinal axis of the vehicle and a loading position in which the stand makes an angle with the longitudinal axis. The stand has at the base thereof sliding devices which facilitate the angular movement thereof. Notwithstanding its equipment and design, the vehicle has a small overall size and is consequently air-transportable. It is adapted to travel in particular in regions having no medical or dispensary centers.

3 Claims, 4 Drawing Figures

AIR-TRANSPORTABLE HIGHLY AUTONOMOUS CROSS-COUNTRY MEDICAL VEHICLE

The invention relates to an air-transportable highly autonomous cross-country medical vehicle adapted to travel in particular in desert regions which have no medical or dispensary centres, this vehicle serving to transport and/or to treat injured persons or victims of accidents and enclosing the necessary equipment for a first-aid intervention.

Medical vehicles termed "ambulances" are well known, but their interior design is poorly adapted to the transport, and in particular the loading, of injured persons. Indeed, the stretchers are usually carried by nurses who, however careful they are in putting the stretcher in the vehicle, tend to jerk the patient, which may have serious consequences if the injury of the patient requires complete immobility.

The invention therefore relates to a cross-country vehicle which is designed and arranged in such manner that the stretchers can be slid inside the vehicle without jerking, said stretchers being locked in the transport position so as to avoid any shock which would be harmful to the transported patient.

According to the invention, there is provided a cross-country medical vehicle capable of travelling over long distances (1 600 km), adapted to travel in particular in desert regions and of the type comprising a chassis carrying a cross-country drive unit and a closed body containing the equipment for medical intervention and caring for the victims of accidents or injured persons, the rear wall of this body being provided with two outwardly openable doors, wherein the body encloses at least two superimposed stretchers which are removably supported by a stand which is movable between two different angular positions, namely a transport position parallel to the longitudinal axis of the vehicle and a loading position in which the stand makes an angle with said longitudinal axis, said stand comprising at the base thereof sliding means facilitating the angular movement thereof.

According to a feature of the invention, the stand is formed by a frame comprising uprights assembled by longitudinal members and cross-members, this frame supporting two platforms at different levels for receiving stretchers.

According to another feature of the invention, the stand is mounted to be angularly movable on a pivot extending through a member having a part fixed to one of the longitudinal walls of the body of the vehicle and a part fixed to the stand, the latter being locked in the transport position in which it is applied against said wall by a manually actuatable lock.

A better understanding of the invention will be had from the ensuing description and the accompanying drawings in which.

The essential object of the invention resides in the arrangement of a medical vehicle and in particular in the design of means for supporting and immobilizing the stretchers.

Figure 1:
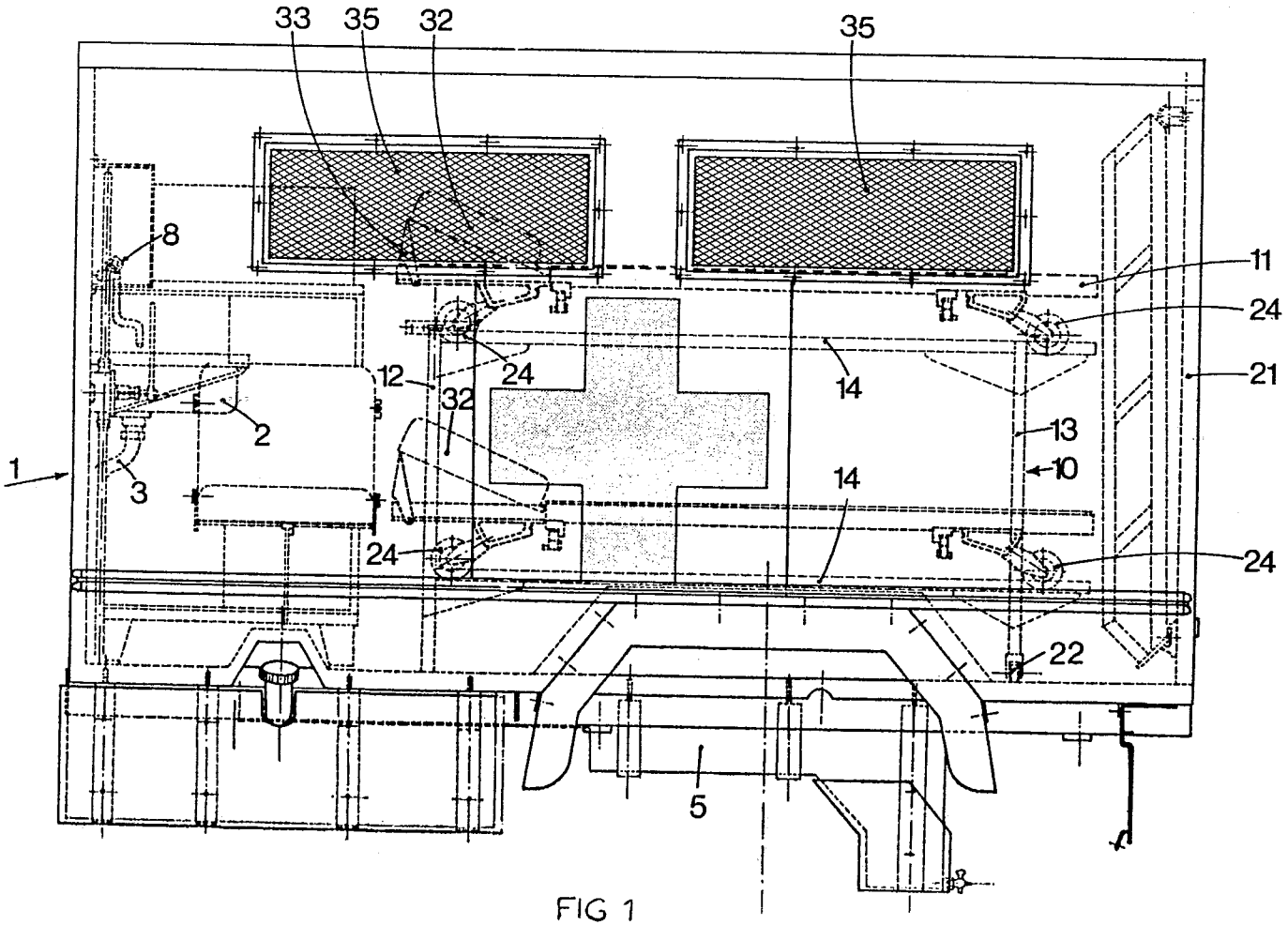
FIG. 1 is a side elevational view of the body of the vehicle the outside dimensions of which permit the airtransport of the vehicle in cargo aircraft C130 and C160.

As can be seen in FIG. 1, the body of the vehicle (the drive unit has not been shown) encloses all the equipment required for transporting and providing first aid to an injured person or a victim of an accident.

This equipment mainly comprises (FIG. 3) a washbasin 2 connected to a waste pipe 3 and supplied with water from an auxiliary tank 4 which draws the water from a main tank 5 (fixed under the floor of the body of the vehicle) by way of a pipe 6 and a suction and ram pump 7, this auxiliary tank 4 having a tap 8.

This equipment further comprises a reanimation and perfusion unit (not shown) and lighting means 9.

Figure 3:
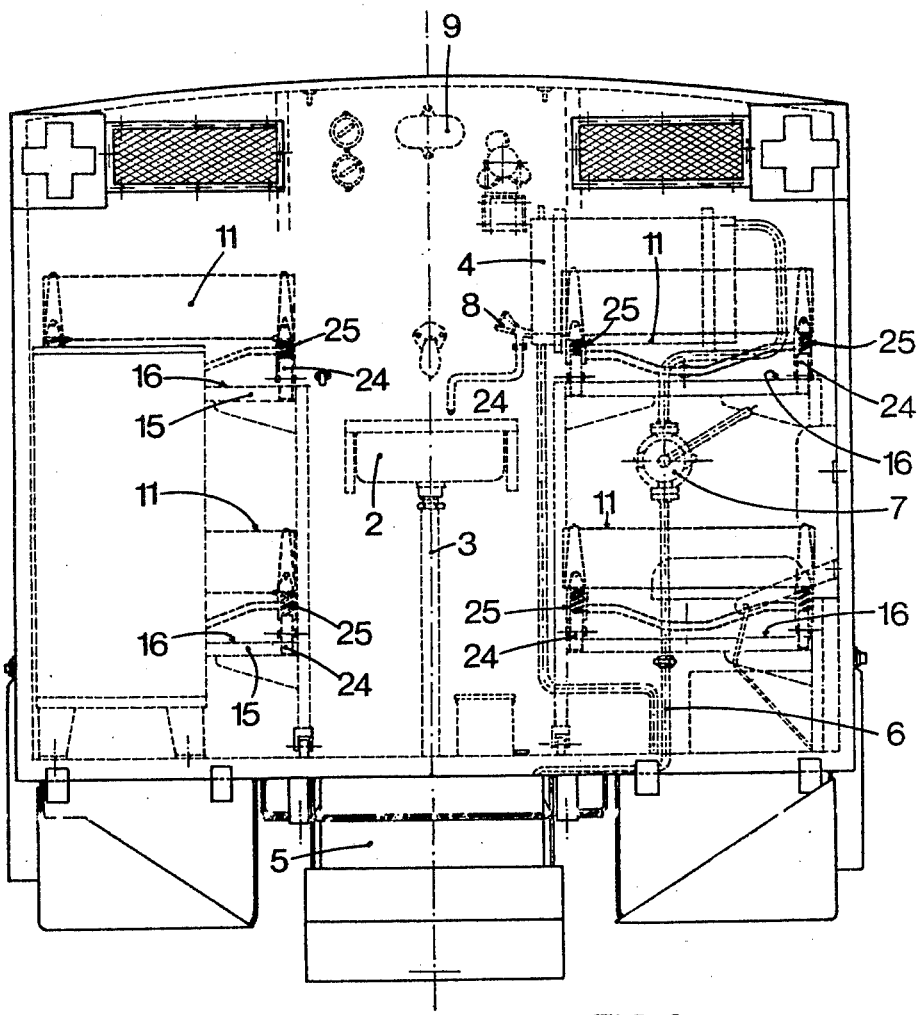
FIG. 3 is a rear end elevational view of the body of the vehicle.

For transporting the patients, there are provided inside the body one or two stands 10 for supporting one or two pairs of superimposed stretchers 11. Each stand comprises two pairs of uprights 12 and 13 which are interconnected by longitudinal members 14 and cross-members 15, this framework serving to fix receiving platforms 16 at two different levels as shown in FIGS. 1 and 3.

These stands have the feature of being movable between two different angular positions, namely a "transport" position and a "loading" position.

For this purpose, each stand is pivotably mounted on a journal 17 which extends through a fork 18 fixed to the inner face of the longitudinal wall 19 of the body of the vehicle facing the corner 20 of the stand. The stand is thus angularly movable about this pivot 17 so as to take up a position either in a plane parallel to the wall 19 in which it is applied against the latter, or in an inclined plane making an angle with the longitudinal wall 19, by a simple rotation about the pivot 17.

Figure 2:
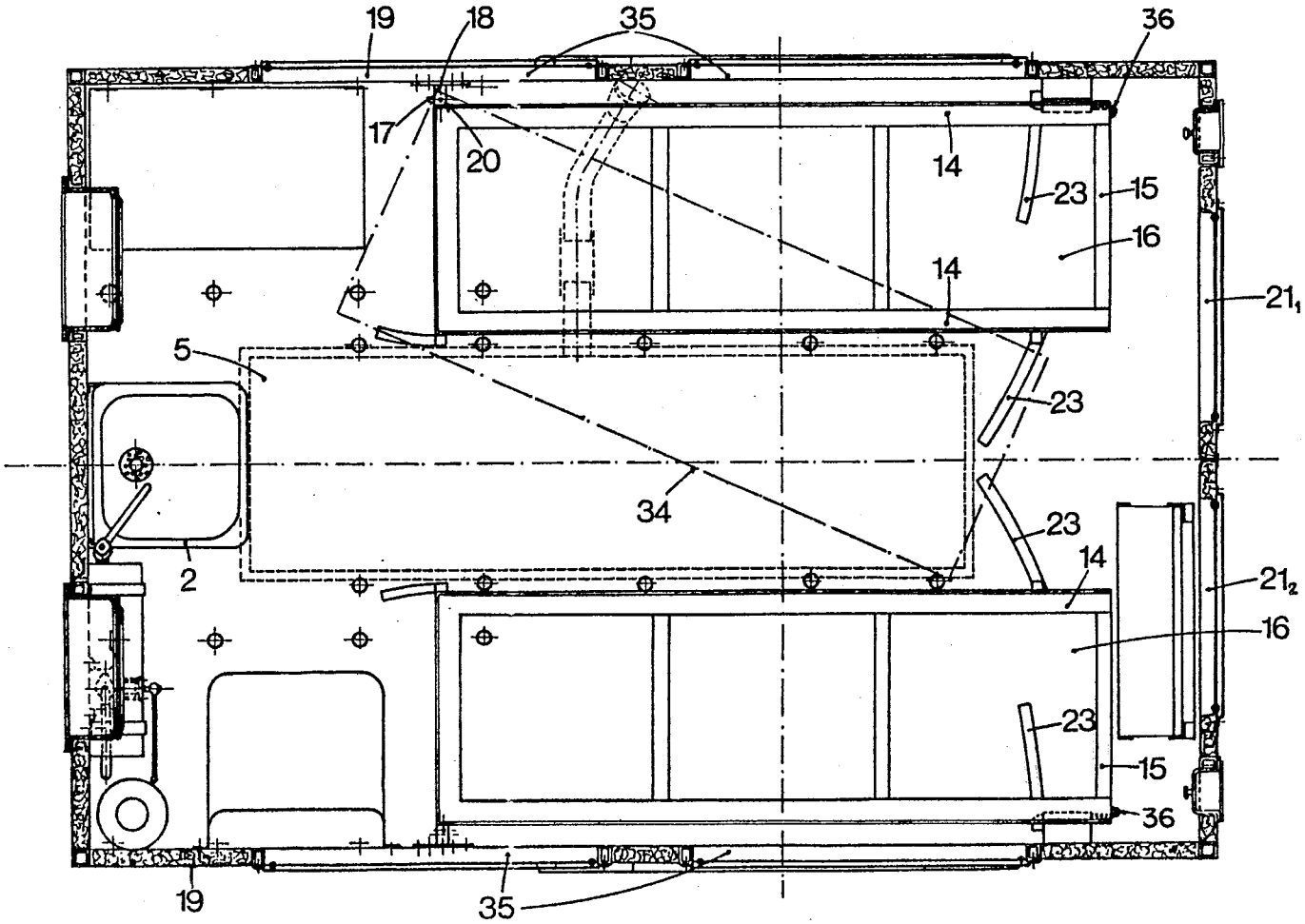
FIG. 2 is a plan view of the vehicle shown in FIG. 1.

In order to facilitate this angular movement of the stands, the base of the two uprights 13 located adjacent to the rear door 21 of the body is provided with rollers 22 which are freely movable along guide tracks 23 in the form of sectors (FIG. 2). The stands are locked in the transport position, that is, in the position shown in FIG. 2, by spring-loaded pull-members 36 the front end of which is provided in the known manner with a hooking nose which engages, for example, on one of the legs of the stand so as to immobilize the latter in the transport position.

The locking of the stand is intended to prevent the latter from moving during transport and producing jerks or shocks harmful to the patient. These stands, in the presently-described embodiment two in number, support two pairs of stretchers 11, the latter having the feature of being removable and supported by rollers 24 mounted as shown in FIG. 3 on shockabsorbers 25, for example coil springs.

Figure 4:
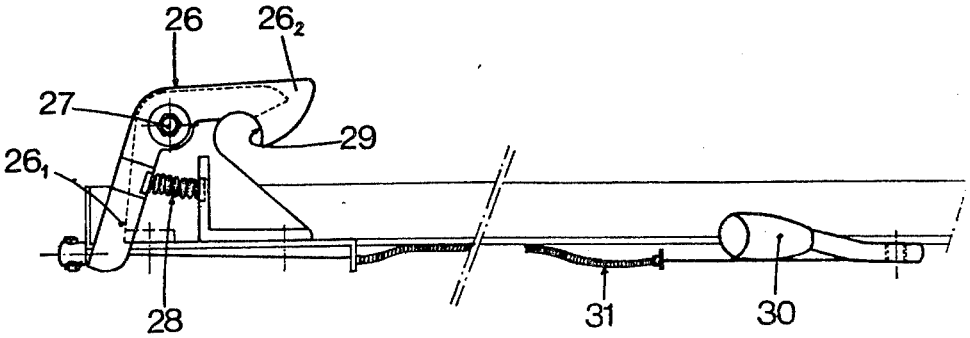
FIG. 4 is a plan view of a spring-loaded pawl for locking stretchers to the stand of the vehicle.

This elastic suspension has for purpose to improve the comfort of the patient and avoid any violent shaking which may have an adverse effect on his condition. The stretchers are also locked in the transport position on their respective stand by the spring-loaded pawls 26 (FIG. 4). Each pawl comprises an L-shaped member which is pivotably mounted on a pin 27, the branch $26_1$ of the pawl being connected to a return spring 28 and the branch $26_2$ being shaped as a hook 29 capable of hooking on one of the fixed parts of the stretcher, for example on a cross-member or one of the feet of the stretcher.

The spring-loaded pawl 26 is unlocked by acting on a handle 30 connected to the pawl by a pulling cable 31 which acts in opposition to the action of the return spring 28. A single pawl per stretcher is sufficient, but it will be understood that, for reasons of safety, the number of pawls may be increased without departing from the scope of the invention.

Also in order to improve the comfort of the patient, each stretcher is provided with a head-rest 32 the inclination of which is adjustable by means of an adjusting cam 33.

It will be understood that the body of the vehicle is provided at the rear with a door 21 having double door members $21_1$ and $21_2$ so as to completely clear the access to the interior of the body and allow the stretchers to be slid onto the stand easily and without jerks.

The stretchers are loaded in the vehicle after unlocking the spring-loaded pull-members 36 and after pivoting the stands 10 to the inclined position 34 as shown in dot-dash line in FIG. 2.

It is sufficient to place the stretchers on the vertically spaced receiving platforms 16 and then lock the stretchers in this position to their respective stand by means of the spring-loaded pawls 26 and then swing the stands back to the position against the longitudinal walls 19 of the body shown in full lines in FIG. 2, the pull-members 23 automatically locking onto the stands in the manner of a spring-loaded bolt of a lock.

For hygienic and ventilating reasons the vehicle body is provided with ventilation openings provided with a screen filter 35.

It must be understood that the invention is not intended to be limited to the embodiment described hereinbefore and shown in the drawings, since other forms and other embodiments of the invention may be envisaged without departing from the scope of the invention as defined in the claims.

I claim:

1. An air-transportable highly autonomous cross-country medical vehicle adapted to travel in particular in desert regions, comprising chassis means, a drive unit and a closed body both carried by the chassis means, the body having a longitudinal axis, equipment for medical intervention and caring for victims of accidents or injured persons contained inside said body, said body comprising a front end wall, a rear end wall having two outwardly operable door members, lateral longitudinal extending walls, and a floor carrying sector-shaped tracks thereon, a stand mounted on said body to be movable between a transport position in which the stand is substantially parallel to said longitudinal axis and a loading position in which the stand makes an angle with said longitudinal axis, said stand comprising a frame including uprights, longitudinal members and cross-members assembled together, at least two superimposed stretchers removably mounted on said stand, two support means on the frame respectively receiving the stretchers, and sliding means associated with a lower part of the stand to facilitate said movement of the stand comprising rear uprights of said uprights of the frame relative to the forward direction of travel of the vehicle having in combination therewith rolling means rollable along said tracks when moving the stand between the transport and loading positions thereof.

2. A vehicle as claimed in claim 1, comprising pivot means interposed between the stand and one of said lateral longitudinally extending walls whereby the stand pivots about said pivot in said movement between the transport and loading positions, and locking means for locking the stand in the transport position in which the stand is applied against said one lateral longitudinally extending wall.

3. An air-transportable highly autonomous cross-country medical vehicle adapted to travel in particular in desert regions, comprising chassis means, a drive unit and a closed body both carried by the chassis means, the body having a longitudinal axis, equipment for medical intervention and caring for victims of accidents or injured persons contained inside said body, said body comprising a front end wall, a rear end wall and lateral longitudinal extending walls, the rear end wall comprising two outwardly operable door members, a stand mounted on said body to be movable between a transport position in which the stand is substantially parallel to said longitudinal axis and a loading position in which the stand makes an angle with said longitudinal axis, sliding means associated with a lower part of the stand to facilitate said movement of the stand, at least two superimposed stretchers removably mounted on the stand, rollers, spring shock-absorbing means mounting the rollers on each stretcher, and locking means for releasably locking each stretcher to the stand comprising spring-loaded pawl means, a handle, cable means connecting the handle to the pawl means, and means for actuating the pawl means, the pawl means comprising hook-shaped means for hookingly engaging the corresponding stretcher in the locking position.

* * * * *